United States Patent [19]

Gatton

[11] Patent Number: 4,533,984

[45] Date of Patent: Aug. 6, 1985

[54] VARIABLE-WIDTH-BEAM LIGHT APPARATUS

[76] Inventor: James W. Gatton, P.O. Box 27/ St. Rte. 97 E., Bellville, Ohio 44813

[21] Appl. No.: 414,973

[22] Filed: Sep. 7, 1982

[51] Int. Cl.[3] ..... F21V 21/14; F21L 15/20; F21S 5/00

[52] U.S. Cl. ..... 362/232; 362/106; 362/184; 362/188; 362/191; 362/197; 362/233; 362/238; 362/250; 362/271; 362/284; 362/288; 362/289; 362/306; 362/324; 362/372; 362/419

[58] Field of Search ..... 362/66, 106, 184, 186, 362/187, 188, 189, 190, 191, 197, 198, 199, 226, 232, 233, 238, 250, 269, 270, 271, 272, 273, 274, 275, 277, 280, 281, 282, 283, 284, 285, 286, 287, 288, 289, 306, 319, 322, 323, 324, 372, 418, 419

[56] References Cited

U.S. PATENT DOCUMENTS

| | | | |
|---|---|---|---|
| 1,514,869 | 11/1924 | Solosabal et al. | 362/324 X |
| 1,682,567 | 8/1928 | Hobbie | 362/287 |
| 1,682,608 | 8/1928 | Dressel | 362/287 |
| 2,071,159 | 2/1937 | Benjamin | 362/285 X |
| 2,874,269 | 2/1959 | Greenlee | 362/277 |
| 2,906,862 | 9/1959 | McCammon | 362/288 X |
| 2,947,851 | 8/1960 | Lozeau | 362/277 X |
| 3,439,160 | 4/1969 | Andreaggi | 362/372 X |
| 3,538,324 | 11/1970 | Hankins | 362/277 |
| 3,886,350 | 5/1975 | Katsukura et al. | 362/287 |
| 4,025,777 | 5/1977 | Hayakawa | 362/250 |
| 4,090,232 | 5/1978 | Golden | 362/106 |
| 4,190,880 | 2/1980 | Esaki | 362/287 X |
| 4,199,802 | 4/1980 | Malm | 362/106 |
| 4,214,295 | 7/1980 | Morton | 362/277 X |
| 4,263,588 | 4/1981 | Gautier | 362/106 X |
| 4,319,308 | 3/1982 | Ippoliti et al. | 362/106 |
| 4,327,403 | 4/1982 | Aubrey | 362/288 |
| 4,336,579 | 6/1982 | Lord | 362/287 X |
| 4,352,150 | 9/1982 | Hosoda | 362/282 |

FOREIGN PATENT DOCUMENTS

| | | | |
|---|---|---|---|
| 236846 | 9/1959 | Australia | 362/282 |
| 702542 | 1/1941 | Fed. Rep. of Germany | 362/188 |
| 873422 | 7/1961 | United Kingdom | 362/106 |

*Primary Examiner*—David H. Brown
*Assistant Examiner*—John E. Griffiths
*Attorney, Agent, or Firm*—Robert E. Stebens

[57] ABSTRACT

A variable-width-beam light apparatus is provided having a lamp and reflector assembly in which a lamp is supported for selective axial displacement along a longitudinal optical axis with respect to a focal point of the reflector to enable adjustment in the width or angle of divergence of an emitted beam of light. The lamp is selectively positioned by a rotatable knob carried by a lens of the assembly and positioned exteriorly at the front of the lens for operation. The rotatable knob connects with a shaft coupled by screw threads with a lamp engaging cylinder that is axially slideable in a tubular guideway such that rotational movement is translated to longitudinal movement to effect and control axial displacement of a lamp. The lamp is resiliently biased in a forward direction with respect to the lens. The lamp and reflector assembly is supported in a housing on journals permitting selective angular positioning of the assembly about an axis disposed transversely to the longitudinal optical axis of the reflector to direct the light beam in a selected direction with respect to the housing. A modification includes two lamp and reflector assemblies incorporated into a unitary structure and mounted for relative rotation in a housing about a single axis.

17 Claims, 17 Drawing Figures

VARIABLE-WIDTH-BEAM LIGHT APPARATUS

FIELD OF THE INVENTION

This invention relates generally to electrically powered lighting apparatus and it relates more specifically to lighting apparatus having capability of selective adjustment of the width of the beam of light that is emitted and angular adjustment of the emitted light beam with reference to a support for the lighting apparatus.

BACKGROUND OF THE INVENTION

This invention is directed to the providing of a selectively adjustable, variable-width-beam light apparatus which is designed to be mounted on a helmet or other suitable headgear that is to be worn by a person and thereby free both hands for other functions. Two general areas of use for lights mounted on a person's headgear are deep tunnel or shaft mining or exploration operations and hunting, although it will be readily recognized that there are many other specific instances where lighting apparatus of this type may be found to be particularly advantageous. The capability of beam width adjustability from a maximum width beam for large area illumination to a minimum width beam for relatively small area illumination greatly enhances the usefulness of a lighting unit. The additional capability of angular adjustment of the central axis of the light beam with reference to a support or a surface further enhances the usefulness of such a lighting apparatus by enabling the wearer of the headgear to direct the light beam to a desired point or area as deemed most advantageous to the wearer regardless of head position or position of the headgear on the person's head.

Lighting apparatus having variable-width-beam capability has been previously devised to either emit a narrow beam for pinpoint illumination of an object or to emit a relatively wide beam to function as a floodlight to illuminate a larger area, or to emit a light beam of intermediate width. The known lighting apparatus having a variablewidth-beam capability incorporate what is generally described as a primary housing in which a light emitting source such as an incandescent electric lamp is mounted and a reflector unit. The reflector unit is provided with a reflecting surface of parabolic configuration with a difference in beam width being achieved through selective positioning of the relative position of the lamp along the longitudinal axis of the reflector extending through the apex of the parabola. In the known light apparatus, the lamp is mounted either in a fixed position in the primary housing and the reflector is selectively displaced along a longitudinal axis with respect to the lamp, or the reflector is mounted in a fixed position on the primary housing with the lamp being selectively positionable along the longitudinal axis. Structures using the movable reflector technique generally employ a telescopic tube construction with the one tube carrying the reflector and being axially displaceable with respect to the other tube carrying the lamp as by a screw-threaded interconnection. Operation of such structures requires that one part of the housing be rotated relative to the other necessitating that at least that part of the housing be substantially fully accessible to permit a person to grip the housing. Prior structures using the movable lamp technique have included an internal, axially displaceable support for the lamp mounted within the primary housing and having relatively complex mechanisms projecting outwardly of the primary housing to permit manual manipulation.

A disadvantage of the known displaceable lamp structures is the relative complexity of the mechanism and/or difficulty of operation. A disadvantage of known lighting apparatus using either structural technique described for achieving the necessary axial displacement is the substantial longitudinal dimension required to obtain the desired variability in beam width. Physical size of the apparatus, particularly length, is important with respect to such structures mounted on headgear.

Another significant disadvantage of the known lamp structures having variable-width-beam capability is their lack of adjustability as to the angle of the emitted light beam and the light support such as a person's headgear. It is particularly advantageous in the case of a headgear mounted light to be able to adjust the beam to a selected angular position in a vertical plane.

SUMMARY OF THE INVENTION

In accordance with this invention, a variable-width-beam lighting apparatus is provided for advantageous use when mounted on a helmet, cap or other type of headgear. The lighting apparatus of this invention is also of a construction enabling the wearer of the headgear on which the lighting apparatus is mounted to adjust the direction of the emitted beam in at least one plane such as the vertical plane. A plastic structural housing is provided for mounting in fixed position on suitable headgear and functions as a support and protective housing for a variable-beam reflector and lamp displacement unit. The structure of this invention, unlike the known prior art variable-width-beam lights in which the reflector is displaced with respect to an illumination source that may be mounted on a support in a fixed position, has a lamp that is displaceable with respect to a reflector unit and the entire reflector unit and lamp assembly is mounted in the protective supporting housing with only the endmost light emitting lens being visible and exposed while that assembly is pivotable in the housing about at least a horizontal axis.

In one embodiment of this invention, the lighting apparatus includes a support housing adapted to be mounted in fixed relationship on a suitable headgear and a lamp and reflector assembly mounted in the support housing so as to be substantially totally protected thereby. The housing is provided with an aperture in a wall thereof with a lens of the reflector assembly disposed in that aperture. Included in the lamp and reflector assembly is a conically shaped reflector having an interior reflecting surface of parabolic configuration, a lamp and supporting mount for the lamp and a lamp positioning mechanism. The supporting mount carries the lamp and provides for axial displacement of the lamp along the longitudinal optical axis of the reflector to permit selective positioning of the lamp with respect to the focal point of the reflector. Selective operation of the lamp positioning mechanism places the lamp at a desired point with respect to the reflector's focal point whereby a light beam of desired width can be obtained within the capabilities of the apparatus.

The lamp supporting mount includes an elongated tube interconnected with the reflector at its apex and this tube extends in coaxial alignment with the reflector's longitudinal axis. This tube receives the lamp and its electric contact assembly and provides support to maintain the lamp in proper position with respect to the reflector's focal point while permitting axial displacement of the lamp along the reflector's longitudinal axis. Spring biased is provided to continually urge the lamp further into the reflector's interior and away from its apex.

Selective control over the position of the lamp is provided by the lamp positioning mechanism. In accordance with this invention, the lamp positioning mechanism includes an external adjusting knob carried by a front lens of the reflector and has a screw-threaded shaft that engages with a displacing cylinder which is axially displaceable along the reflector's longitudinal axis and engages with the top of the lamp. Rotation of the external and readily accessible adjusting knob effects axial displacement of the cylinder to either displace the lamp against the biasing spring or to permit the biasing spring to displace the lamp in an opposite direction. With the adjusting knob being centrally located in the reflector lens and of relatively small dimension, it does not significantly affect the light that is emitted because the major portion of the light emitted is reflected light and not light that would have been directly emitted by the lamp in a forward direction along the longitudinal axis of the reflector.

In this embodiment of the lighting apparatus, the lamp and reflector assembly are mounted in the housing by a pivot mechanism to permit limited rotation of the assemby about a horizontal axis. A detent mechanism maintains the assembly in a selected position.

A modified lighting apparatus embodying this invention includes two lamps and respective reflectors carried on a single supporting lens with the assembly mounted in a housing specifically adapted to be secured to a helmet such as the type worn by motorcyclists. The assembly is also preferably mounted in the housing to permit rotation about a horizontal axis. Although in the illustrative embodiment of this modified lighting apparatus, both lamps and respective reflectors are carried by a single supporting lens, thereby maintaining alignment of both light beams, it is contemplated that individual and independently rotatable support may be provided for each lamp and reflector. In either instance, each lamp is provided with its independently operable positioning mechanism.

An important objective of this invention is to provide a variable-width-beam lighting apparatus which is of extremely economical and durable construction. This is achieved through mounting of the lamp and reflector assembly substantially entirely within the protective support housing. Only the front light emitting lens is exposed and the only operating mechanism or component that is exposed is the adjusting knob at the center of the lens.

Another objective of this invention is providing of a lighting apparatus of the generally described type and which incorporates a structure that enables the lamp to be quickly changed and with relative ease. Accordingly, the lamp positioning mechanism is constructed so that it may be removed from the lens and to thereby provide access to the lamp which may be removed or inserted through an opening in which the positioning mechanism is normally mounted. Changing of a lamp can be accomplished with disassembly of the lamp and reflector or removal thereof from the housing.

An additional objective is the providing of a variable-width-beam lighting apparatus in which the reflector is constructed so as to tend to avoid the formation of alternate dark and light rings that are generally obtained with conventional reflectors having only a smooth, polished surface. Important aspects of this objective are the forming of the reflector surface with a parabolic configuration and forming a portion of the reflector that is adjacent the apex thereof with a faceted surface consisting of a multiplicity of flat-surfaced, rectangularly shaped elements.

These and other objects and advantages of this invention will be readily apparent from the following detailed description of illustrative embodiments thereof. Reference will be had to the accompanying drawings which illustrate embodiments of the invention.

DESCRIPTION OF THE DRAWING FIGURES

DESCRIPTION OF THE ILLUSTRATIVE EMBODIMENTS

Figure 1:
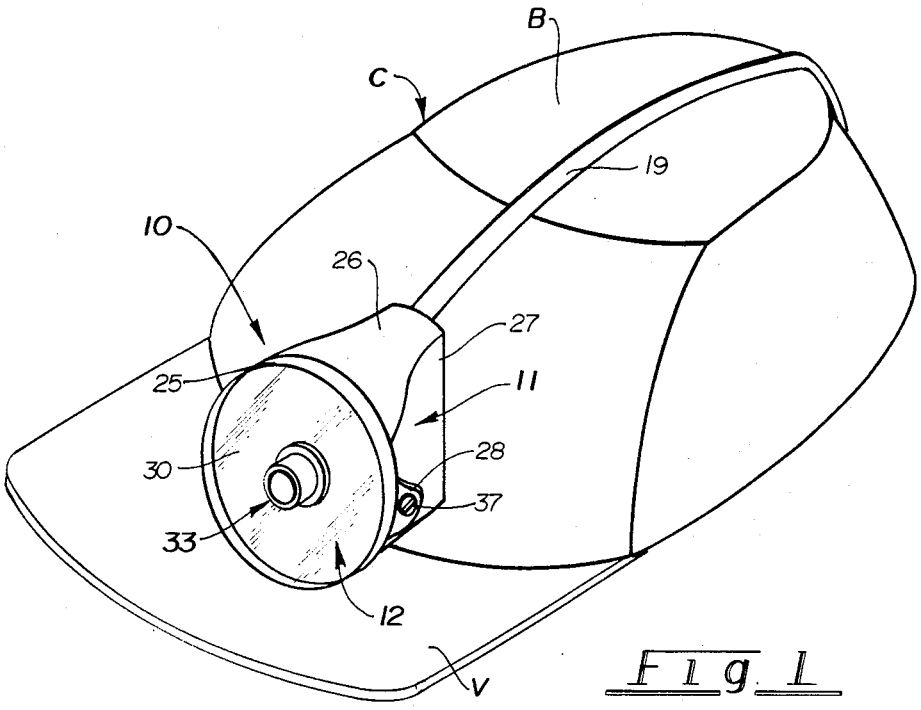
FIG. 1 is a perspective view of a cap provided with a variable-width-beam light apparatus embodying this invention.

Referring first to FIG. 1 of the drawings, a variable-width-beam light apparatus 10 embodying this invention is shown mounted on a cap C such as that which may be worn by a hunter or by someone engaged in an activity that may also be particularly benefited by use of an apparatus of this nature. The cap C, as illustrated in FIG. 1, incorporates a conventional structure and configuration having a main body B configured to fit securely on a person's head. The cap body B embodies conventional construction techniques and is appropriately sized for a particular individual or it may incorporate size adjustment features. A cap of this type is also provided with a visor V which projects a distance forwardly from the cap body B and is substantially rigidly interconnected therewith. This interconnection of the visor to the cap body is generally of the type wherein the visor V will be maintained at a particular angular relationship to the cap body.

Figure 3:
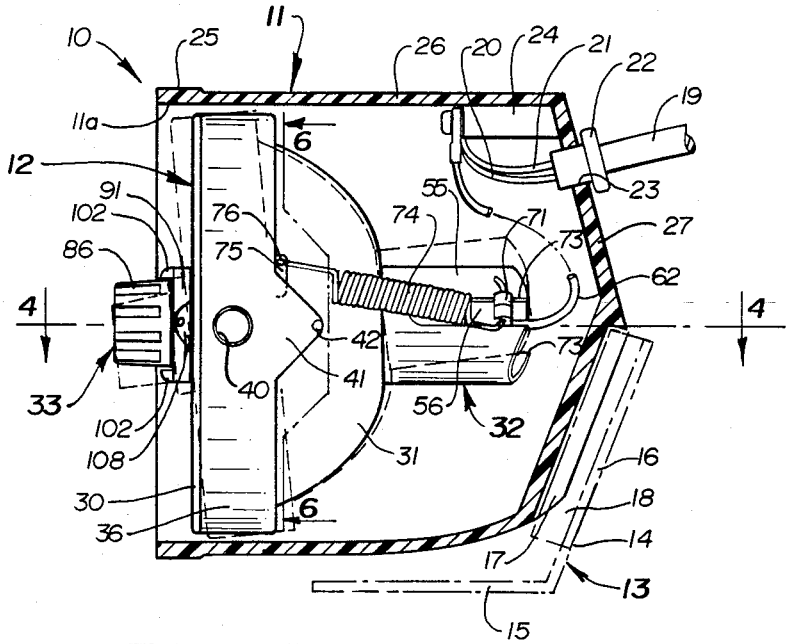
FIG. 3 is a vertical longitudinal sectional view taken along line 3—3 of FIG. 2.
Figure 5:
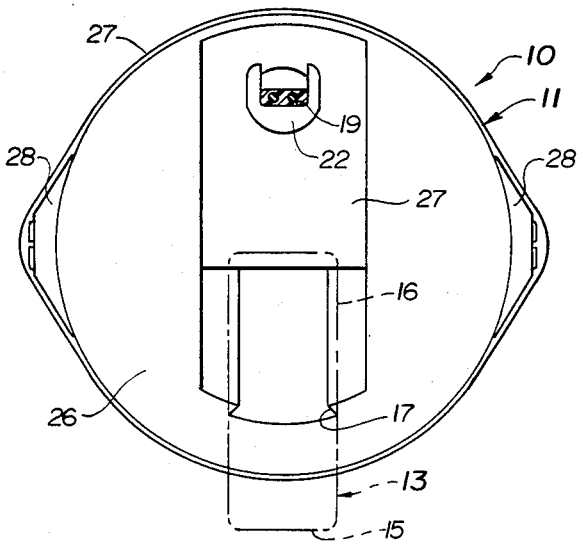
FIG. 5 is a rear elevational view thereof.
Figure 9:
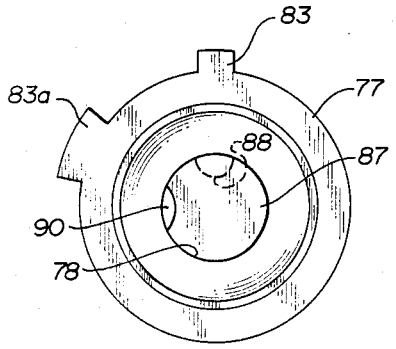
FIG. 9 is an end view of the structure shown in FIG. 8 as seen from the right side of FIG. 8.

As can be best seen in FIGS. 1, 3 and 5, the light apparatus 10 includes a support housing 11 and a light emitting lamp and reflector assembly 12 with that assembly being disposed substantially within the interior of the housing. The support housing 11 is formed as a structurally rigid shell defining an interior cavity and being essentially open at the one end with this open end effectively forming an aperture 11*a* through which the light beam will be emitted. A housing of this type may be readily fabricated by suitable molding techniques from appropriate plastic materials. Mounting of the light apparatus on the cap C, or other type of headgear as will also be illustrated, may be effected by any suitable attachment or mounting devices that are appropriate for the particular light apparatus and the specific headgear with which the apparatus is to be utilized and mounted thereon. To illustrate a typical mounting device, FIGS. 3 and 5 indicate in phantom lines a mounting bracket 13 which is designed to mount the apparatus on the cap visor. This mounting bracket comprises in general an L-shaped support strut 14 having a base leg 15 and a connecting leg 16 and which may be formed as an integral structure from a material such as steel which exhibits sufficient structural strength characteristics for this intended purpose. The base leg 15 is adapted to be positioned on the upper surface of the cap visor V and fixedly secured thereto by suitable fastening devices (not shown). As can be seen by reference to FIG. 1, the light apparatus 10 is disposed closely adjacent to the juncture of the visor and cap body thereby resulting in the mounting bracket 13 also being disposed closely adjacent thereto such that the connecting leg 16 will extend upwardly in closely disposed adjacent relationship to the forwardly facing surface of the cap body to thereby locate the light apparatus 10 as close as possible to the cap body.

In accordance with this invention, the light apparatus and the illustrative mounting bracket 13 are specifically designed to enable the two components to be readily assembled and disassembled. The objective of this is that the light apparatus 10 may thus be removed from the cap when it is not being utilized and consequently eliminate the added weight that would otherwise be carried by the person's head at those times when the light is not needed or would serve no useful function. This feature of removability or disassembly of the light apparatus with respect to the mounting bracket is advantageously achieved by a sliding type of interconnection. For this purpose, the rear wall of the support housing 11 of the light apparatus is formed with a vertically extending, elongated slot 17 which is configured as a channel having a dovetail-type cross-section and is open at the bottom of the housing. Mechanical interconnection with the mounting bracket 13 is obtained by means of a cooperatively configured connector plate 18 which is fastened to the connecting leg 16 of the support strut 14 and has the same dovetail cross-section and can thus be inserted or removed from the slot 17. This specific mounting of a light apparatus embodying this invention on a cap or other headgear is deemed exemplary and other structures capable of achieving the same objective or performing the same function in association with other types of headgear are contemplated whether with or without the removability feature.

The light apparatus 10 includes an electrical lamp which will be described in conjunction with other illustrative drawing figures, and thus, requires a source of electrical power. Since the light apparatus is primarily intended to be of a highly portable and mobile nature, the lamp is of a type that may be energized from a battery-type power source. It is also contemplated that utility and versatility in use of the light apparatus is enhanced and promoted by means of a portable battery-type power pack that would be carried by the individual using a particular light apparatus. To avoid having extreme weight added to the person's head, the battery pack is preferably remotely located and, although not illustrated in the drawings, may be of a belt or shoulder-type mounting. Electrical interconnection of the light apparatus 10 with a battery pack is effected through a flexible electrical cable 19 that includes a pair of electrical conductors 20 and 21 such as can be seen in FIG. 3. Preferably, the cable 19 extends over the top of the cap C and downwardly at the back of the person's neck so as to result in the least interference in normal head and neck movements. Although not illustrated, it is advantageous to provide a means of securing the cable 19 at the bottom rear of the cap to aid in maintaining the cable in position on the cap. A forward end of the cable 19 extends into the interior of the support housing 11 through a strain relief fitting 22 which may be of the type that, when inserted in an aperture 23 formed in the rear wall of the housing, will mechanically retain the fitting and also frictionally grip the cable to prevent it from being pulled out of the fitting. The inner ends of the conductors 20 and 21 are also preferably secured to a mounting block 24 which is integrally formed on the interior of the housing.

The support housing 11 in the illustrative embodiment, as indicated, comprises a structurally rigid shell fabricated from a suitable plastic material by an appropriate molding process. The housing is of a thinwalled construction having a support ring section 23 that is open at the front of the housing and a closed end section 26. As can be best seen in FIGS. 3 and 4, the light emitting reflector and lamp assembly 12 is seen to have a general triangular shape with the front thereof being circular. In this illustrative embodiment, it is preferred that the reflector and lamp assembly 12 be supported for pivotable movement only about a horizontal axis and thus the closed end section 26 of the housing may have the side wall portions thereof convergent in a rear direction to reduce the overall size of the housing. Thus, the walls forming the housing terminate in a generally rectangularly shaped, vertically disposed rear wall 27, but with the housing configured to assure that there is sufficient interior clearance between the narrowed side walls and the top and bottom walls to permit pivoting of the reflector and lamp assembly. This pivoting movement of the reflector and lamp assembly is indicated in broken lines in FIG. 3. It will also be noted that the slot 17 adapted to cooperatively interfit with the mounting bracket 13 is formed in this rear wall 27 as is the aperture 23 in which the strain relief fitting 22 is mounted for retention of the cable 19. Integrally formed with the support ring section 25 are a pair of bearing mounts 28 which comprise thickened wall sections and respective threaded apertures 29 located in diametrically opposed relationship on a central horizontally extending axis.

Included in the light emitting reflector and lamp assembly 12 is a lens 30, reflector 31, lamp supporting mount 32, lamp displacing mechanism 33 and an electric lamp 34. These components are illustrated in assembled relationship with respect to each other in FIGS. 3 and 4 as well as being mounted and positioned within the support housing 11. Certain of the components are shown independently of others and on a larger scale for clarity of illustration in FIGS. 6–11. The lens 30 comprises a circular plate 35 and an integrally formed cylindrical flange 36. A suitable plastic material which will result in forming of a structurally rigid component may be utilized in the fabrication of the lens. Such a material will also be optically transparent to permit light generated in the assembly to exit through the central circular plate 35. Pivotal mounting of the lamp and reflector assembly 12 within the support housing 11 is effected by a pair of trunnions 37. Each of the trunnions 37 includes a short axle 38 formed on the end of a screw-threaded cap screw 39. Each cap screw 39 is threaded into a respective aperture 29 formed in the bearing mounts 28 and projects its axle 38 interiorly of the inner surface of the housing's main section 25 to interfit in a socket 40 formed in a wall of the cylindrical flange 36. Each of the sockets 40 and axles 38 are relatively dimensioned to permit relative rotation of the lens 30 about a horizontal axis that is thus defined by the diametrically opposed trunnions 37.

Figure 12:
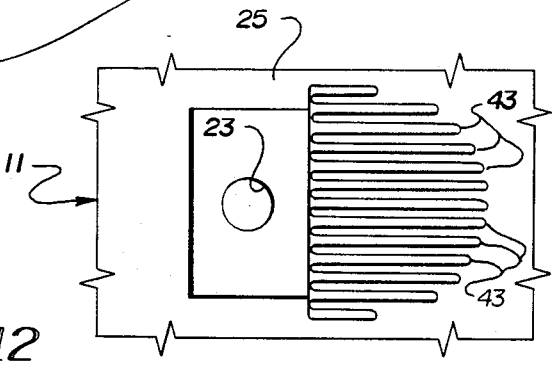
FIG. 12 is a fragmentary sectional view on a substantially enlarged scale taken along line 12—12 of FIG. 4.

A positioning mechanism is also provided to assure that the lens 30 will be maintained in the position to which it is revolved with respect to its axis of rotation and the housing 11. This positioning mechanism includes a lever arm 41 that extends a distance rearwardly with respect to the circular lens plate 35 and its associated flange 36 to mechanically interengage with an interior wall surface of the housing. Two such lever arms 41 are provided with each being diametrically located with respect to each other at opposite sides of the lens and each may be formed as an integral part of the lens 30 as a lateral projection of the flange 36. Each lever arm 41, as can be best seen in FIG. 3, is of triangular shape and is provided at its extreme rearward apex with a locking lug 42 projecting laterally outward from the plate-form lever arm. This locking lug 42 is designed to mechanically interlock with any selected pair of a series of longitudinally extending ribs 43 that cooperatively form grooves that are integrally formed on an interior surface of the housing as can be best seen in FIG. 12. As a consequence of inherent slight flexibility of the lever arm 41, revolution of the lens 30 about its horizontal axis will result in displacement of the lever arm and its locking lug 42 into engagement with any one of the desired pairs of locking ribs or the grooves thus formed by those ribs. This mechanism will thus securely maintain the lens 30 in a desired selected position, but will permit its subsequent displacement to another position. It will be noted that the relative dimensions of the locking lugs 42 and ribs 43 is such that only slight flexing of the lever arm 41 is required to permit such operation.

Figure 6:
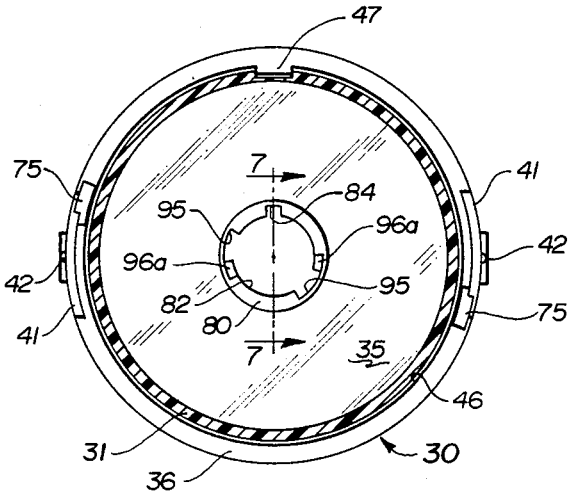
FIG. 6 is a vertical sectional view of the lamp and reflector assembly taken along line 6—6 of FIG. 3.
Figure 10:
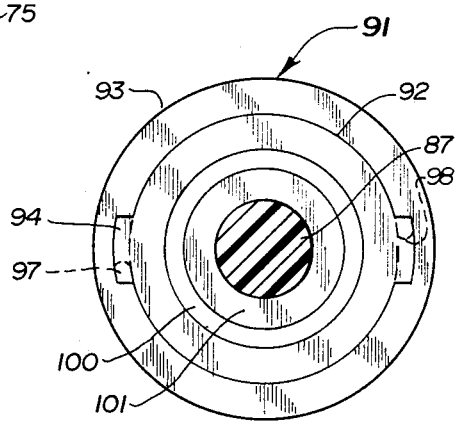
FIG. 10 is a sectional view taken along line 10—10 of FIG. 8.

Carried by the lens 30 is the reflector 31 which also, in turn, carries the lamp supporting mount 32. In accordance with this invention, the reflector 31 and lamp supporting mount 32 are integrally formed as a unitary structure by appropriate molding techniques from a suitable plastic material. The reflector 31 is of a parabolic shape having an interior reflecting surface 45 which is formed by applying a coating of highly reflective material to the structural shell of the reflector. Formed at the front end of the reflector 31 is a mounting ring 46. This mounting ring, which is formed on the exterior of the reflector's shell, comprises a cylindrical surface having a diameter that will result in an interference fit with the interior surface of the lens' cylindrical flange 36 when assembled therewith. Since the functioning of the various mechanisms are dependent on a particular location of certain components, an indexing device is also provided to assure that the reflector 31 will be properly angularly positioned with respect to the lens 30. This indexing device is of a key and slot type as can be seen in FIG. 6. A longitudinally extending key 47 is formed on an interior wall of the flange 36 and projects a slight distance radially inward thereof. Interfitting in cooperative relationship therewith is a slot formed in the outwardly facing surface of the mounting ring 46 of the reflector. With this indexing device, proper orientation of the reflector 31 with the lens 30 will be assured during assembly. While it has been indicated that an interference fit is provided to mechanically secure the lens and reflector in assembled relationship, suitable adhesives may also be utilized if deemed necessary.

A parabolic reflector is utilized for the objective of enabling the reflector to generally direct the light in a direction along a longitudinal axis of a reflector. Selected positioning of the lamp 34 along this longitudinal axis and with respect to a focal point which is not specifically designated in the drawings, but would be located closely adjacent or in the region of the apex of the reflector, will result in the light being emitted either generally parallel to the longitudinal axis or have components thereof directed in divergent relationship thereto. Depending upon the relative position of the lamp and its effective light emitting point with respect to the reflector's focal point, it is possible to obtain a variation in the extent or degree of divergence of the emitted light relative to the reflector's longitudinal axis. Accordingly, mechanisms are provided to effect this selective displacement of the lamp 34 with respect to the reflective surface 45 of the reflector. In accordance with this invention, such mechanisms include components of the lamp supporting mount 32 and the lamp displacing mechanism 33 with the structure of these components and their function described in greater detail hereinafter.

Figure 2:
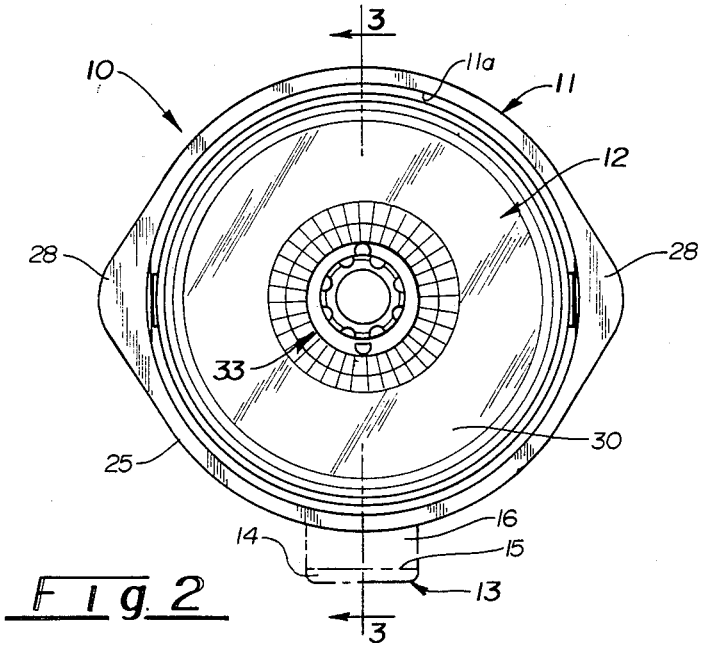
FIG. 2 is a front elevational view of the variable-widthbeam light apparatus.

To improve the light emission characteristics of this particular apparatus, it is preferred that a portion of the interior reflector surface not be continuously curved. This can be best seen in FIGS. 2 and 4 wherein a portion of the reflecting surface 45 that is most closely adjacent the apex of the reflector is formed with several annular rings 48 with each ring including a plurality of substantially flat-surfaced segments 49. These segments 49 are substantially rectangularly shaped and thus results in a surface having a faceted appearance. Forming this portion of a parabolic reflector surface with such flat surfaced segments has a tendency to effectively eliminate circular rings that are frequently generated in reflectors wherein the entire interior surface has a continuous, smooth curvature configured in accordance with the geometrics of the reflector.

The lamp 34, in this lighting appartus, is a low voltage incandescent type device which preferably is designed to operate at a voltage in the range of 6 to 12 volts. A conventional lamp 34 of this type is utilized in this apparatus and includes a base having a screw-threaded shell 50 which forms one electrical contact and second center contact 51 formed as an axial projection at the extreme terminal end of the lamp base. The upper part of the lamp 34 comprises a glass envelope in which the filament 52 is located. A circular aperture 53 is formed at the apex of the reflector 31 and is of a diameter slightly greater than the maximum diameter of the lamp, particularly the glass envelope portion. Although a lamp having a screw-threaded base is shown, it will be understood that a flange base lamp may also be used without necessitating any changes in the structure of the illustrative embodiment of the invention provided that the flange is of a diameter such that it will not interfere with movement of the bulb.

Forming the lamp support mount 32 is an elongated supporting tube 55 and a lamp carrier 56. The supporting tube 55 is of a cylindrical configuration and is coaxially aligned with the longitudinal optical axis of the reflector 31. Positioned within the supporting tube 55 which forms a tubular guideway therefor is the lamp carrier 56 which is also an elongated tubular structure, and is shown on an enlarged scale in FIG. 11 with its components separated for clarity of illustration. The carrier is formed from an electrically insulative material, for example, plastic, and has an internal diameter which is only slightly greater than the diameter of the lamp's threaded shell 50 and will thus receive that portion of the lamp base in coaxial relationship within the interior of the carrier and permit relative axial displacement. One end of the tubular carrier 56 has the interior surface 57 of one marginal end portion arcuately curved to facilitate insertion of the lamp base into the carrier. The opposite end of the carrier is closed by a wall 58 which provides a mount or support for components that effects electrical interconnection with the lamp. One of these components is a helical spring 59 of predetermined length to have its opposite ends contactingly engage the wall 58 and a bottom radial surface portion of the threaded shell 50. This spring is formed from an electrically conductive material and thus provides an electrically conductive path from the threaded shell 50 to a conductor 60 which provides the means of interconnection to one of the conductors 20 or 21 of the electrical cable 19. This interconnection is indicated in FIG. 3. A second component of the electrical interconnection is a center electrical contact 61 which also has an electrical conductor 62 connected therewith and connecting with the other of the conductors 21 or 20. This center contact 61 comprises an elongated rod formed from an electrically conductive material terminating in a contact head 63. Mounting of the contact 61 is effected by a bushing 64 formed from an electrically insulative plastic and which is positionable in the wall 58. This bushing 64 is cylindrical and of two different diameters, thus resulting in a shoulder 65 at the juncture of the two different diameter sections. The smaller diameter section interfits in a socket 66 formed in the end wall 58 in central coaxial relationship to the carrier 56 with the shoulder 65 thus resting in supported relationship on the interior surface of the wall 58. Thus, the contact head 63 is placed in the interior of the carrier where it will contactingly engage the center contact 51 of the lamp and with the relatively larger diameter portion of the bushing 64 projecting coaxially into the spring 59, but not interfering with its functioning. Applying a sufficient force on the lamp 34 will result in its being axially displaced into the interior of the carrier to an extent where its center contact 51 will engage the contact head 63 and form an electrical circuit therewith. Concurrently, the helical spring 59 engages the bottom end of the lamp shell 50 and is supported on the wall 58 and forms an electrical interconnection between the conductor 60 and the lamp 34.

Figure 11:
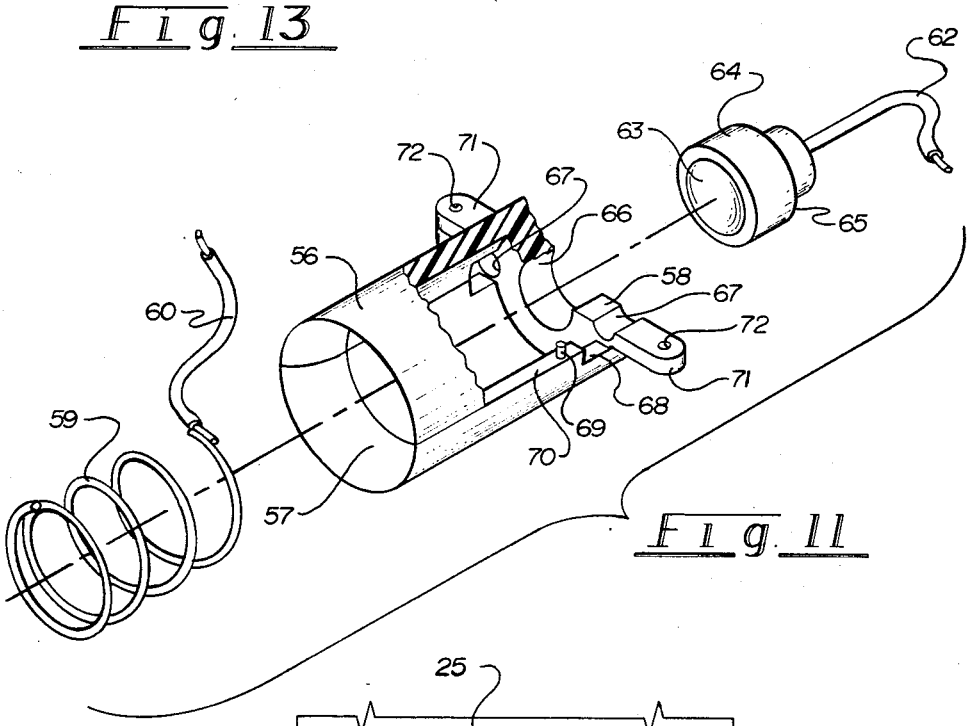
FIG. 11 is a perspective view on an enlarged scale of a lamp support assembly with the components thereof separated and portions broken away for clarity of illustration.

Referring is particular to FIG. 11 where the carrier 56 is shown on a substantially enlarged scale and having portions thereof broken away to better illustrate the construction and functional relationship of the components, it will be seen that the carrier is formed in two sections along a center longitudinal plane. This construction enables the carrier to be assembled with the bushing 64 and to also provide a means for securing the conductors 60 and 62 to the carrier to avoid interference with its operation. Each of the two sections forming the carrier are identical in construction with two axially extending channels 67 formed in the end wall 58 through which a conductor such as 62 may be trained and exit laterally from the carrier through a cooperatively located recess 68 formed in the cylindrical wall. When the two sections of the carrier are assembled, the channels 67 in each section will cooperatively form circular apertures and each recess 68 will be of a generally rectangular shape. The one conductor 60 connected to the spring 58 merely exits the carrier through the one recess 68. Interconnection and positioning of the two sections in proper alignment is effected by means of a plurality of locating pins 69, only one of which is shown in FIG. 11, although four are provided with two of the pins being located in the longitudinal face 70 at one side of each of the carrier sections. Receiving sockets (not shown) for each pin are formed in the wall of the opposed portion of that carrier section and open at the respective longitudinal face 70. A pair of radially outward extending guide lugs 71 are also integrally formed with each carrier section in radial alignment with the wall 58 and are positioned to be aligned with a similar lug on the opposite section. Each of the lugs 71 is also provided with a small aperture 72 for interconnection with a spring as will be subsequently described.

Figure 4:
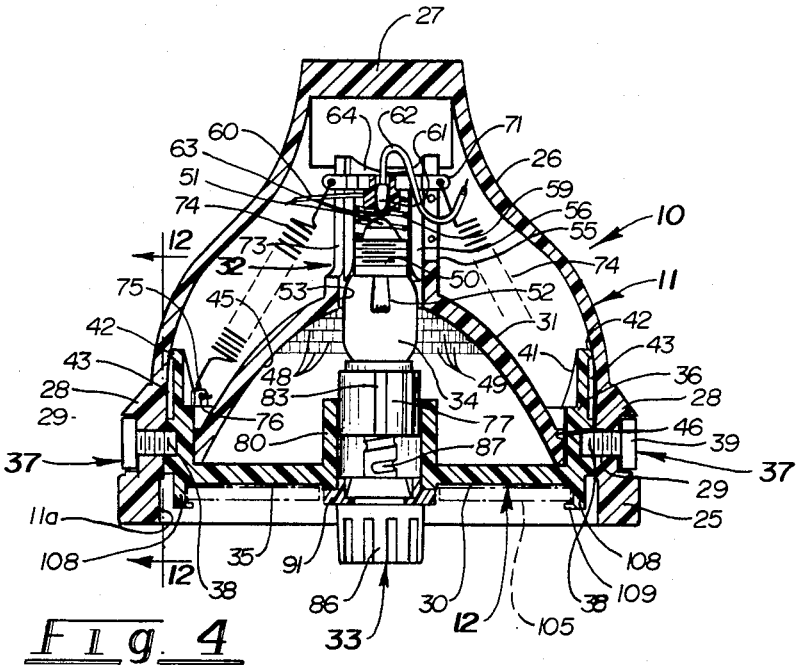
FIG. 4 is a horizontal sectional view taken along line 4—4 of FIG. 3.

As previously noted, the lamp 34 is relatively displaceable along a longitudinal axis of the reflector 31 to achieve the variation in the extent of divergence of the emitted light beam with respect to that longitudinal axis. Consequently, the lamp carrier 56 is positioned within the supporting tube 55 which is configured to permit this relative axial displacement. Referring specifically to FIGS. 3 and 4, it will be seen that the supporting tube 55 is provided with a pair of diametrically opposed and longitudinally extending guide slots 73 that permit projection of the guide lugs 71 outwardly therethrough. Each of these slots opens at a rearwardmost end of the tube 55 and is of a width to receive a respective guide lug 71 of the carrier 56. Thus, it will be seen that these guide lugs 71 may reciprocate within the respective slots 73 as a consequence of axial displacement of the carrier relative to the tube and perform a guiding function in that they prevent rotation of the carrier in the supporting tube. This will prevent any rotation that may result in entanglement of the conductors 60 and 62.

The carrier 56 is biased in a forward direction by means of a pair of helical springs 74. Each of these springs 74 has one end thereof connected with the guide lug 71 by having its hook-shaped end portion projected through the respective aligned apertures 72 of the guide lugs 71. The opposite end of each spring 74 is interconnected and secured to the lens 30, and thus, by appropriate dimensioning of the springs, result in generation of a force that resiliently urges the carrier 56 in a forward direction, or toward the lens. Securing of the forward ends of the spring 74 to the lens is effected by respective connector lugs 75 that are also advantageously integrally formed with the lens flange 36 at its rearward edge. Each of the connector lugs 75 is provided with an aperture 76 through which an end hook of the respective spring 74 may be extended. Referring specifically to FIG. 3, it will be noted that the guide slots 73, while formed in diametrically opposed relationship to each other in the supporting tube 55, are not oriented in a plane which is in parallel relationship with respect to the axis of rotation of the reflector 31 and the lens 30. Specifically, the slots 73 are oriented in an angularly displaced relationship to cooperate with the location of the aperture 76 of the spring connector lug 75. The objective of this skewed relationship is to assure that there will be a direct line of force with respect to the guide lugs 71 and a minimization of frictional binding forces that could otherwise develop between the guide lug 71 and the respective slots 73.

Opposing the biasing force of the helical spring 74 is the lamp displacing mechanism 33. In accordance with this invention, the displacing mechanism 33 is located and carried by the lens 30 and is coaxially oriented on the longitudinal optical axis of the reflector. Included in the lamp displacing mechanism 33 is a lamp displacing element in the form of a lamp contacting cylinder 77. This cylinder 77, as well as other components of the lamp displacing mechanism, are shown in greater detail in FIGS. 7–10. This cylinder is of a predetermined length and has a central cylindrical bore 78 that is open at each end of the cylinder. Formed in one end face of the cylinder is an arcuately curved socket 79 that is coaxially aligned with the bore 78 and which is configured to cooperatively interengage with the arcuate surface of an end portion of the lamp 34. Most lamps of this type have a same general configuration for the particular size lamp that is used regardless of the manufacturer, and thus, the socket 79 will interfit with most lamps that are of this design. The socket 79 is also coaxially aligned with the bore 78 and functions primarily to locate the lamp 34 and to prevent lateral displacement of the lamp from the longitudinal axis of the reflector as a consequence of axial longitudinal displacing movement of the lamp.

As can be readily seen by reference to FIG. 4, axial displacement of the cylinder 77 will result in similar axial displacement of the lamp 34. Support of the cylinder 77 for this axial displacement is provided by a cylindrical guideway 80. The guideway 80 comprises a cylindrically walled structure that is advantageously integrally formed with the circular plate 35 of the lens and extends primarily interiorly of the lens and reflector 31, but having an annular end face 81 at the exterior side of the lens. The diameter of the cylinder 77 and interior wall 82 of the guideway 80 are substantially the same, but permit axial sliding movement of the one component relative to the other. However, resistance to relative rotational movement is provided by cooperatively interfitting key and slot conformations 83, 84 that are formed in these components. In the illustrative embodiment as can be best seen in FIG. 6 as well as FIG. 9, an axially extending slot 84 is formed in the wall of the guideway 80 and opens to the interior of the guideway. Formed on the exterior of the cylinder 77 is an elongated, axially extending key 83 which interfits in the slot with both of these elements having a generally square or rectangular cross-section. Also formed on the exterior of the cylinder is an auxiliary orientation key **83*a*** that extends longitudinally of the cylinder and functions to properly orient the components as will be described in further detail.

The mechanism providing means to effect manual operation and displacement of the cylinder comprises a screw-threaded actuator 85. This actuator 85 includes as the manually operable control element thereof an external knob 86 integrally formed with an elongated, axially extending threaded shaft 87. This threaded shaft 87 is of a diameter to project through the cylindrical bore 78 of the cylinder 77 and is designed to produce an axial displacement of the cylinder as a consequence of rotation of the shaft. Formed on the exterior of the shaft 87 is a helical groove 88 having a relatively large pitch to effect a relatively large axial displacement of the cylinder for a single revolution of the shaft. Mechanical interconnection between the shaft 87 and the cylinder 77 is effected by a projection 89 formed on the inner wall of the cylinder's bore 78 closely adjacent the end face of the cylinder at the opposite end from the curved socket 79. This projection 89 is also configured to cooperatively interfit into the helical groove 88 which is arcuately curved in cross-section and the projection thus functions as screw drive means to effect the mechanical interconnection and operation. In this illustrative embodiment, it will also be noted that the groove 88 has a blocking element 90 formed therein at the terminal end of the shaft which will prevent the inadvertent complete unthreading of the shaft from the cylinder. This blocking element comprises an upstanding rib formed in the groove at the extreme end of the shaft and which extends a slight distance upwardly from the bottom of the groove to prevent unrestricted passage of the projection into or out of the groove. This element, however, is not so large that, by applying a small amount of force, the cylinder may be assembled with or disassembled from the shaft.

Figure 7:
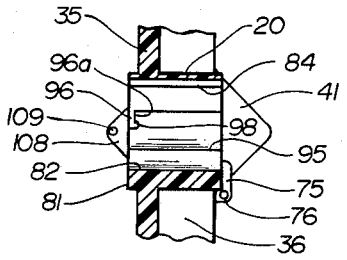
FIG. 7 is a fragmentary longitudinal sectional view on an enlarged scale taken along line 7—7 of FIG. 6.
Figure 8:
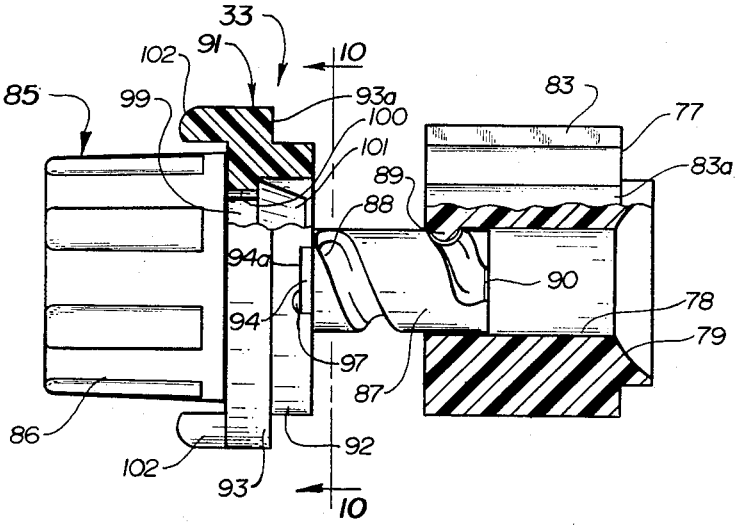
FIG. 8 is a partial medial longitudinal sectional view on a relatively enlarged scale of a lamp displacing mechanism.

Mounting of the actuator 85 on the circular lens plate 35 is effected through a lock ring 91. This lock ring 91 includes a cylindrical bearing surface 92 which interfits in supported relationship into cooperatively configured socket formed in an end of the cylindrical guideway 80 and is rotatable against the cylindrical wall 82. Integrally formed with the lock ring 91 is a radially outwardly extending circular flange 93 having an annular bearing surface **93*a* which will thus overlie and contactingly engage the adjacent annular surface 81 at the end of the guideway 80 at the front of the circular lens plate 35. Securing of the lock ring 91 in association with the circular lens plate 35 is effected by a pair of diametrically opposed locking lugs 94 that are formed on the circular bearing surface 92 and project a distance radially outward therefrom. Each of these locking lugs is designed to project axially into respective axially extending slots 95 formed on the interior of the guideway 80. Referring to FIGS. 6 and 7, it will be seen that the outer end of each slot 95 is formed with a small end wall 96 at the exterior end of the guideway and which end wall overlies only a portion of the respective slot 95, thereby enabling the locking lug 94 to pass into or out of the slot. Positioning of the lock ring 91 to result in insertion of the locking lugs 94 into respective slots 95 with the bearing surface 93*a* in contact with the end face 81 will position those lugs at a point such that they will have mating surfaces 94***a*, 96*a* aligned in the interior of the guideway. Locking is effected by a slight relative rotation of the locking ring in the guideway causing the locking lugs 94 to move into overlapped relationship with the respective end walls 96. A secure mechanical interlock is achieved by forming respective detents 97 and 98 on the lugs 94 and end wall 96 at relative locations such that with the locking ring rotated to a lock position, there detents will be on relatively opposite sides and secure the lock ring in position in the guideway 80.

The actuator 85 is secured to the locking ring by means to prevent axial displacement, but which permits relative rotational movement. For this purpose, the knob 86 is formed with a cylindrical bearing 99 projecting axially at its inwardly facing end and which is journalled in a bearing ring 100 formed in the lock ring 91. Mechanical securing of the knob to the lock ring is effected by a locking flange 101. This locking flange 101 comprises an annular ring integrally formed in inwardly spaced relationship with respect to the inner end face of the knob and is of a relatively larger diameter than the bearing ring 99. Thus, the locking flange 101 will be effective in securing the bearing ring between these two components. Assembly of the actuator with the lock ring is facilitated by forming the locking flange 101 with a conically tapered surface such that the smaller end will guide the flange through the bearing ring 100 when a proper amount of force is applied thereto. These components are formed from a suitable plastic material that will provide sufficient resilience to enable the components to expand or contract and permit assembly in this manner. Assembly is further facilitated by maintaining a minimal difference in the maximum diameter of the locking flange 101 and the interior diameter of the bearing ring 100.

In order that sufficient force may be applied to position the lock ring 91 in the circular bearing surface 92 and effect interlocking of the detents 97 and 98, a pair of gripping lugs 102 are formed on the lock ring. Each lug 102 comprises a rod shaped element integrally formed adjacent the outer periphery of the ring and extends axially in outwardly directed relationship and project a distance over the knob 86. These lugs 102 provide a convenient means for enhancing the ability of a person to grip the lock ring and rotating it into locked or unlocked engagement.

Operation of the apparatus to effect displacement of the lamp 34 and effect a change in the divergence of the light beam that will be emitted from the reflector 31 will be readily apparent and seen to comprise a simple rotational movement of an external operating knob 86. Locating the operating knob 86 at the center front of the lens provides a convenient point of access and ease in locating of the knob. A simple rotational movement of the knob will effect displacement of the cylinder 77 in a direction to effect the desired change in the divergence of the light beam. It will also be noted that although this mechanism is located at the center of the light emitting unit, it will have substantially little, if any, effect on the light that is thus emitted with a parabolic reflector associated with incandescent lamps. The light that is emitted is generally produced by the filament 52 in a manner such that it is primarily radiated in a lateral direction. A relatively small portion of the light is emitted in a longitudinal axial direction. Thus, location of the operating mechanism at the center and minimizing the physical dimensions thereof will not result in any serious interference with the light that is emitted by this unit as the light first travels radially outward to the reflector surface 45 before it begins to travel in a forward direction. A further advantage of the structure provided in accordance with this invention to effect the longitudinal displacement and positioning of the lamp 34 is that it enables convenient replacement of the lamp 34 as may be necessary. The diameter of the guideway's interior wall 82 is slightly greater than the diameter of the lamp 34, and thus, a lamp may be inserted into the interior of the structure through this guideway. This is accomplished by removal of the screw-threaded actuator 85 by disengagement of the lock ring 91 and permitting the lamp 34 to pass outwardly through the guideway. The springs 74, which bias the carrier 56 in a forward direction, will cause the carrier to move the lamp 34 in a direction forward to a sufficient extent to cause the front of the lamp 34 to enter into the guideway 80 before the rear of the lamp, specifically the threaded shell 50, exits from the carrier. Replacement of the lamp is effected in a reverse manner.

Figure 13:
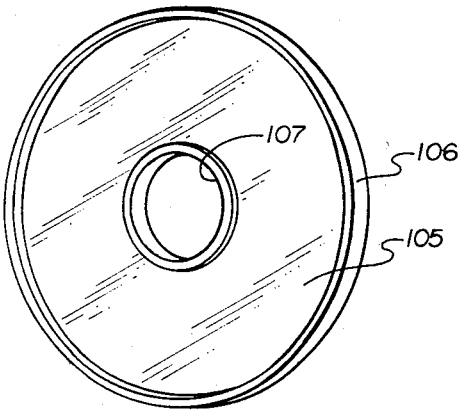
FIG. 13 is a perspective view of an auxiliary lens removably mountable on the front of a lamp and reflector assembly.

There are times when it is advantageous to have a different colored light, such as a red light, provided by the apparatus. Provision is made for this in the illustrative embodiment through providing of a removable lens plate 105 such as that which is shown in FIG. 13. This lens plate 105 comprises a circular disc formed with an outer peripheral flange 106 and a center aperture 107. The aperture 107 is of a diameter substantially equal to the diameter of the lock ring 91 and will thus enable this auxiliary lens plate to be positioned on the front of the primary lens 30. Securing of the auxiliary lens in position on the front of the lens 30 is effected by a pair of latch brackets 108. These latch brackets 108, as can be best seen in FIGS. 3 and 4, are triangularly shaped and integrally formed with the cylindrical flange 36 of the lens and project a distance forwardly therefrom. Integrally formed at the apex of each of the brackets 108 is an inwardly directed projection 109 which extends into overlying relationship with respect to the flange 106. Because of the inherent resilience of the brackets which are formed from a plastic material, the auxiliary lens may be forcibly pushed onto the front of the lens 30 with the outer flange 106 by-passing the projections 109 until becoming disposed in underlying and retained relationship with respect thereto. Removal of the auxiliary lens may be easily effected by lifting up from one or both sides of the auxiliary lens to again forcibly cause the flanges to pass over the projections.

Figure 14:
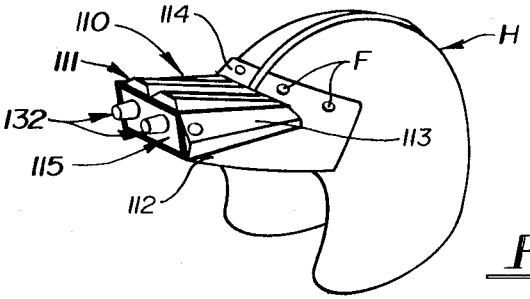
FIG. 14 is a perspective view of a modification of the variable-width-beam light apparatus mounted on a helmet.

A modified light apparatus embodying this invention is illustrated in FIGS. 14–17. This particular modified structure designated generally by the numeral 110 is designed specifically for mounting on a helmet such as that of the type customarily worn by motorcyclists. An objective of this modified light apparatus is to provide a greater amount of light than that which could be provided by a single unit light structure described in the preceding description and shown in the associated drawing figures without having to enlarge the unit and use a larger lamp and perhaps require a higher voltage lamp. Accordingly, this modified unit includes two light emitting elements which are of the same general construction as those previously described, but which are incorporated in a unitary structure and are carried in a single support housing 111. Referring to FIG. 14, it will be seen that this housing, in general, comprises a base section 112 and a cover section 113. The two sections are detachably secured together as it is convenient for fabrication and assembly or mounting of the apparatus to form this housing in two sections. The base section 112 is provided with a mounting flange 114 that is configured to overlie an exterior surface of a helmet H in conforming relationship and is provided with fastening devices F for securing of the structure to the helmet. Referring to FIG. 14, it will also be noted that this structure has a front light emitting lens of rectangular shape with the longest dimension extending in a horizontal plane. It will also be noted that the cover 113 is configured to provide sufficient interior space to permit pivoting of the light emitting lamp and reflector assembly 115 about a horizontal axis in much the same manner as with the single element unit previously described.

Figure 17:
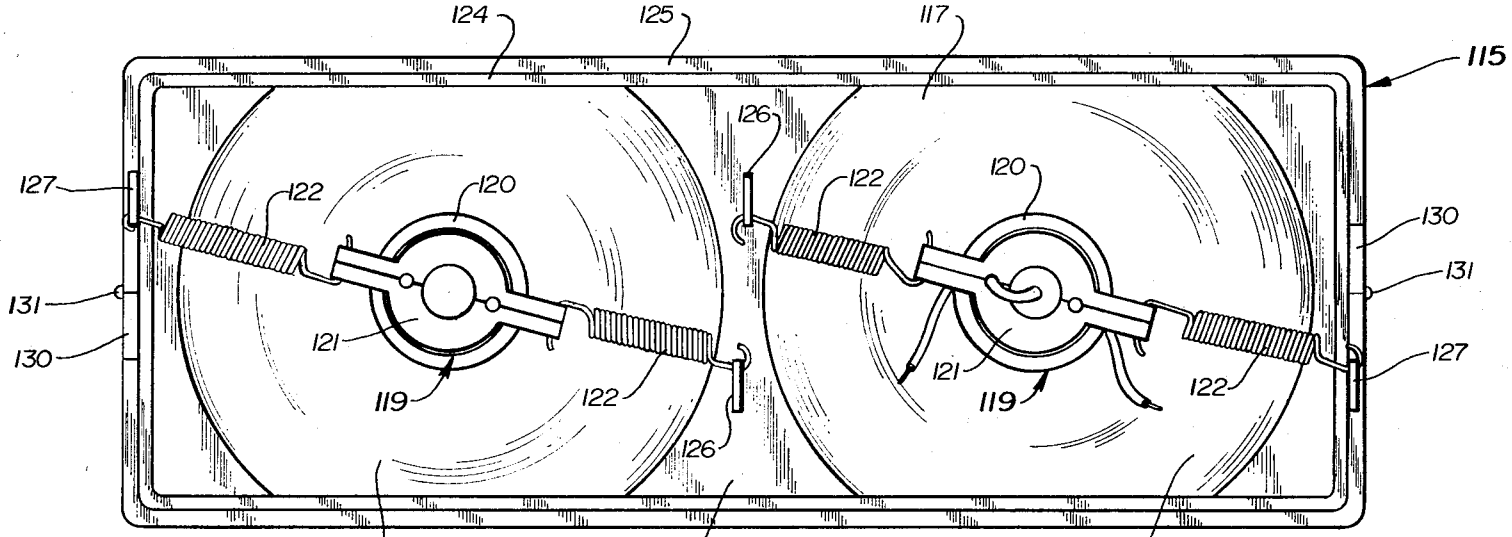
FIG. 17 is a rear elevational view of the lamp and reflector assembly of the modified apparatus.
Figure 15:
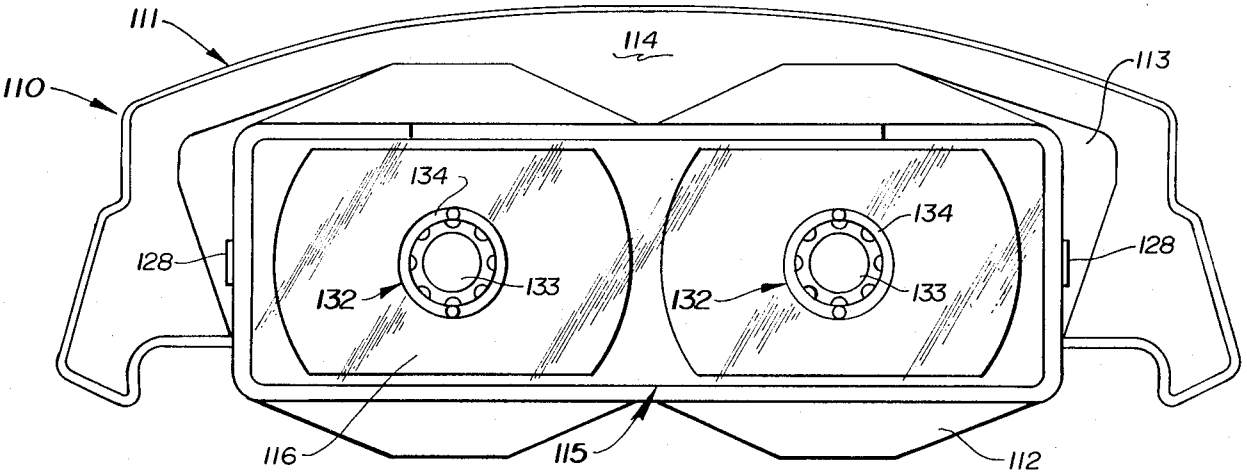
FIG. 15 is a front elevational view on an enlarged scale of the light apparatus of the modified apparatus.
Figure 16:
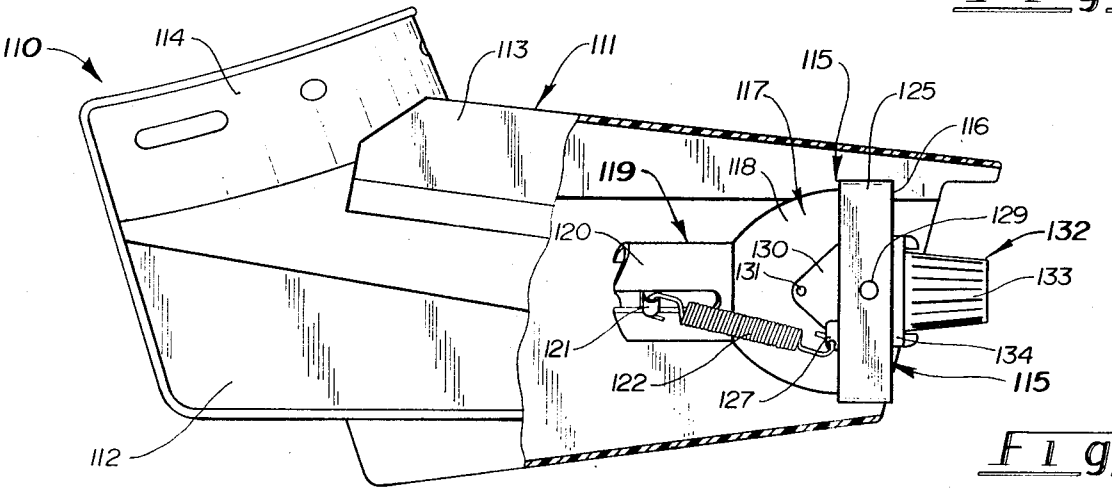
FIG. 16 is a side elevational view of the modified apparatus with portions of the housing broken away to show interior components.

Referring specifically to FIGS. 15, 16 and 17, it will be seen that the light emitting lamp and reflector assembly 115 includes a lens 116 that is of a rectangular shape having a configuration substantially the same as that defined at the front opening formed by the base 112 and cover 113. The lens is also dimensioned to be positioned within the open end of the support housing and to be pivotable to a limited extent about a horizontal axis. Referring in particular to FIGS. 15 and 16, it will be noted that the base 112 and cover 113 are formed with a specific configuration to provide a sufficient vertical dimension to enable the movement of the lamp and reflector assembly in a pivotable direction about the horizontal axis. A dual reflector unit 117 is carried by the lens and this unit includes two identically configured reflectors 118 carrying respective lamp supporting mounts 119. Each of the reflectors 118 is constructed and configured similar to the reflector incorporated in the first described embodiment. Each of the lamp supporting mounts 119 is also identical to the mounts incorporated in the first described embodiment having an elongated supporting tube 120 and a lamp carrier 121 supported for axial reciprocating displacement in the tube 120. Respective pairs of springs 122 are similarly provided to bias the lamp carrier 121 in a forward direction with respect to the lens 116.

While each of the reflectors 118 and this dual reflector unit 117 have a configuration substantially the same as that of the previously described single reflector unit, there is the difference that portions of the parabolically shaped reflector shells are omitted to reduce the vertical dimension of the reflector units. This reduction in vertical dimension, as necessary to minimize the vertical height of the overall lens unit, but the reduction is not of such an extent that it will detract from the optical efficiency of the reflector to any significant degree. Referring to FIG. 17, it can be clearly seen that the reflectors 118 thus have segmental portions of the complete reflector shell eliminated at the top and bottom sections. Each of the reflectors 118 is integrally molded with a face plate 123 having a peripheral flange 124. This flange 124 extends rearwardly with respect to the base plate and is dimensioned to fit securely within a retaining flange 125 which is included in the lens 116 and also projects rearwardly with respect to the front face of that lens. Preferably, the flanges 124 and 125 are relatively dimensioned with a tolerance to result in an interference fit to assure that the two elements will be retained in mechanically secured relationship. If necessary, suitable adhesives may be utilized to assure a secure mechanical engagement.

A pair of spring connector lugs 126 are integrally molded with the reflector base plate 123 at the center thereof between the two reflectors 118 for engagement with the respective springs 122. These connector lugs project a distance rearwardly from the face plate 123. A similar pair of spring connector lugs are integrally formed on the lens flange 125 at opposite vertical sides thereof and also project a distance rearwardly with respect to the flange and interconnect with the respective springs 122.

As previously noted, this dual light unit is also constructed in a manner such that the light emitting lamp and reflector assembly 115 may be pivoted to a certain degree about a horizontal pivot axis. For this purpose, a pair of trunnions 128 are provided as can be seen in FIGS. 14 and 15 at respective sides of the support housing 111. Each of these trunnions 128 is constructed similar to that described with respect to the single lamp unit and is threaded into the cover section 113 of the housing. Each trunnion 128 includes an axle (not shown) which projects horizontally inwardly with respect to the housing and is journalled in a respective socket 129 that is formed in the lens flange 125. The socket 129 in one side of the flange can be seen in FIG. 16. Maintenance of the lamp and reflector assembly 115 in any selected angular position is achieved by a mechanism similar to that previously described and which includes a lever arm 130. A lever arm 130 is integrally formed with and provided with each of the vertical portions of the lens flange 125 and projects a distance rearwardly with respect thereto. Each lever arm is also provided with an outwardly projecting locking lug 131 adapted to interengage with respective sets of locking ribs (not shown).

Respective lamp displacing mechanism 132 are also provided for each of the associated reflectors 118 and respective lamp supporting mounts 119. Each lamp displacing mechanism 132 comprises a structure similar to that previously described in detail and is seen in the drawing figures of the modification as including an actuator 133 operating with a lock ring 134. Each of the actuators to the extent seen in the drawing figures includes an external knob to permit manipulation of the mechanism.

Function and operation of the modified unit 110 is essentially the same as that described with a single lamp unit. The lens and reflector assembly can be pivoted about its horizontal axis to direct the light in a desired angular relationship with respect to the mounting and positioning of the supporting helmet structure. Displacement of the lens assembly to the desired position is readily accomplished by persons merely gripping one of the actuators 133 at the front of the housing and moving the assembly to the desired position. Also, the person can selectively adjust the extent of angular divergence of the emitted light beam independently as to each of the two reflectors 118. Also, as in the case of a single lamp unit, this adjustment as to the angular divergence of the emitted light beam is readily accomplished through small rotational movement of the actuator knob which is readily acceptable at the front of the lens.

It will be readily apparent from the foregoing detailed description of illustrative embodiments of the invention that a particularly novel and useful variable-width-beam light apparatus is provided. The construction of the light emitting reflector and lamp assembly of each illustrative embodiment incorporates a unique mechanism for obtaining selective axial displacement of a lamp with respect to a parabolic reflector resulting in obtaining of precise adjustment and control over the divergence of the emitted light beam. The assembly is of a relatively simple mechanical structure having an actuating mechanism located at the front of the light emitting lens where it is readily acceptable for operation by a person utilizing such an apparatus. The construction having the actuating or operating mechanism located on the front of the lens at the center thereof not only provides convenient accessibility for operation of the mechanisms to obtain the required axial displacement without any significant interference with the emission of the light, but it also provides convenient access to the lamp itself for interchange when a lamp needs to be replaced. Additionally, the construction of the reflector and lens assembly in accordance with this invention enables the assembly itself to be mounted within a protective and substantially enclosing housing in a manner to permit rotation of the assembly about at least the one axis to permit selection in the direction of the beam of light that is emitted from the assembly and in conjunction with the advantageous feature of selective adjustment of the angle of divergence of the emitted light.

Having thus described this invention, what is claimed is:

1. A variable-width-beam light apparatus comprising (A) a support housing adapted to be mounted on a support structure, said housing having an interior cavity and an aperture formed in a wall of the housing, and (B) a light-emitting lamp and reflector assembly mounted in said housing cavity to emit a beam of light through said housing aperture, said assembly including (1) mounting means mechanically interengageable with said housing for securing of said assembly in said housing, (2) an electrically energized lamp, (3) an optical reflector having a reflecting surface configured to reflect light emitted from said lamp in a relatively forward direction along a longitudinal axis of said reflector that extends through a focal point of the reflecting surface as a beam of light having a width determined by the position of said lamp with respect to the focal point when disposed on the longitudinal axis of the reflector, (4) a lens supported on said optical reflector in relatively forward relationship to the focal point of said reflector along the longitudinal axis of the reflector for transmission of the reflected light therethrough, (5) lamp positioning means for positioning of said lamp at a selected position along the longitudinal axis of said reflector including (a) lamp supporting means mounted on said reflector having a lamp carrier supported for reciprocating displacement along a path disposed in parallel relationship to the longitudinal axis of said reflector and biasing means mechanically coupled with said lamp carrier to bias said carrier toward said lens, said lamp carrier adapted to receive and support said lamp on said longitudinal axis for reciprocating movement along said axis, and (b) lamp displacing means mounted on said lens and cooperatively engageable with said lamp carried by said lamp carrier, said lamp displacing means including a guideway mounted on said lens in fixed relationship thereto, a lamp displacing element that contactingly engages with said lamp that is carried by said lamp carrier, carried by said guideway in cooperative engagement therewith for axial reciprocation relative thereto along the longitudinal axis of said reflector and restrained against rotation about the longitudinal axis and an actuator carried by said lens and mechanically coupled with said lamp displacing element and selectively operable to effect axial reciprocation of said lamp displacing element to effect reciprocation of said lamp, said lamp displacing means selectively operable to effect and control displacement of said lamp along the longitudinal axis of said reflector to a selected position.

2. A light apparatus according to claim 1 wherein said mounting means includes pivot means, said pivot means enabling rotational movement of said assembly about an axis disposed substantially transversely to the longitudinal axis of said reflector.

3. A light apparatus according to claim 1 wherein said lamp supporting means includes an elongated tubular guideway extending parallel to the longitudinal axis of said reflector, said lamp carrier being disposed in said guideway for axial reciprocation therethrough.

4. A light apparatus according to claim 3 wherein said tubular guideway includes stop means cooperatively engageable with said lamp carrier to limit displacement thereof in a forward direction.

5. A light apparatus according to claim 3 wherein said lamp carrier includes biasing means cooperatively interengageable with said lamp carried thereby to resiliently bias said lamp into cooperative engagement with said lamp displacing means.

6. A light apparatus according to claim 1 wherein said reflector is disposed relatively rearward of said lens and is operable to direct light in a relatively forward direction through said lens, and said lamp supporting means is disposed relatively rearward of said reflector.

7. A light apparatus according to claim 6 wherein said lamp supporting means includes an elongated tubular guideway carried by said reflector and disposed in coaxial alignment with the longitudinal axis thereof, said lamp carrier being disposed in said guideway for axial reciprocation therethrough.

8. A light apparatus according to claim 1 wherein said lamp and reflector assembly includes at least two optical reflectors and two respective lamp positioning means.

9. A light apparatus according to claim 8 wherein said mounting means includes pivot means, said pivot means enabling simultaneous rotational movement of said assembly about an axis disposed substantially transversely to the longitudinal axis of said reflectors.

10. A light apparatus according to claim 9 wherein said lamp and reflector assembly includes a single lens and said reflectors are mounted on said lens in spaced relationship to each other with their longitudinal axes disposed substantially transversely to the axis of rotation of said lamp and reflector assembly.

11. A light apparatus according to claim 1 wherein said actuator includes a control element projecting relatively forward of said lens and mounted for relative rotation about an axis disposed in substantially parallel relationship to the longitudinal axis.

12. A light apparatus according to claim 11 wherein said actuator includes an elongated shaft adapted to extend axially inward of the lens and mounting means for releasably mechanically securing of said actuator with said lens.

13. A light apparatus according to claim 12 wherein said mounting means includes a locking ring in which said actuator is journalled for rotation, said lens having a socket in which said locking ring is removably positionable.

14. A light apparatus according to claim 11 wherein said lamp displacing element is supported on said lens for axial reciprocating movement and is mechanically coupled with said actuator control element to be axially reciprocated in response to rotation of said control element.

15. A light apparatus according to claim 14 wherein said lamp displacing element and said actuator control element are mechanically coupled by cooperative screw drive means.

16. A light apparatus according to claim 1 or 15 wherein said guideway is an open ended tube and said lamp displacing element is an elongated cylinder, said guideway having a central bore of a size to permit passage of said lamp therethrough.

17. A light apparatus according to claim 16 wherein said actuator and said lamp displacing element are selectively removable from said lens.

* * * * *